US007913886B2

(12) United States Patent
Viswanathan

(10) Patent No.: US 7,913,886 B2
(45) Date of Patent: Mar. 29, 2011

(54) ATTACHING LOADER BUCKET TO TRACTOR FOR SHIPPING

(75) Inventor: Hariharan Viswanathan, Augusta, GA (US)

(73) Assignee: Deere & Company, Moline, IL (US)

( * ) Notice: Subject to any disclaimer, the term of this patent is extended or adjusted under 35 U.S.C. 154(b) by 788 days.

(21) Appl. No.: 11/775,362

(22) Filed: Jul. 10, 2007

(65) Prior Publication Data

US 2009/0016869 A1 Jan. 15, 2009

(51) Int. Cl.
*B60R 9/00* (2006.01)

(52) U.S. Cl. ..... 224/410; 410/80; 248/200; 248/300; 414/685

(58) Field of Classification Search ..... 414/685, 414/686; 224/400, 410; 248/200, 300; 410/80
See application file for complete search history.

(56) References Cited

U.S. PATENT DOCUMENTS

| | | | | |
|---|---|---|---|---|
| 2,499,654 | A * | 3/1950 | Kuhlman | 224/410 |
| 3,512,665 | A | 5/1970 | Westendorf | |
| 3,833,136 | A | 9/1974 | Spicer et al. | |
| 4,085,856 | A | 4/1978 | Westendorf | |
| 4,253,793 | A | 3/1981 | Braml | |
| 4,373,852 | A | 2/1983 | Maurer | |
| 4,470,751 | A | 9/1984 | Masuzawa et al. | |
| 4,576,543 | A | 3/1986 | Kuchyt et al. | |
| 4,643,631 | A | 2/1987 | Maurer et al. | |
| 4,787,811 | A | 11/1988 | Langenfeld et al. | |
| 4,797,051 | A | 1/1989 | Langenfeld et al. | |
| 4,798,511 | A | 1/1989 | Kaczmarczyk et al. | |
| 4,884,940 | A | 12/1989 | Steinkamp et al. | |
| 6,374,520 | B1 | 4/2002 | Westendorf et al. | |
| 6,799,936 | B2 | 10/2004 | Sprinkle | |
| 6,994,511 | B2 | 2/2006 | Westendorf et al. | |
| 6,997,667 | B2 * | 2/2006 | Hackett et al. | 414/685 |
| 7,448,838 | B2 * | 11/2008 | Bunting | 414/23 |
| 2006/0182592 | A1 * | 8/2006 | Stender et al. | 414/686 |

* cited by examiner

*Primary Examiner* — Donald Underwood

(57) ABSTRACT

A loader bucket is attached for tractor shipping in a non-operational position between the front and rear wheels of the tractor. The loader bucket may be attached to the mast using a bracket between a first surface of the loader bucket and the mast, and a brace between a second surface of the loader bucket and the bracket, to resist pivotal movement of the loader bucket.

8 Claims, 4 Drawing Sheets

ATTACHING LOADER BUCKET TO TRACTOR FOR SHIPPING

FIELD OF THE INVENTION

This invention relates generally to compact utility tractors equipped with front end loader attachments, and more specifically to shipping compact utility tractors with front end loaders.

BACKGROUND OF THE INVENTION

Recent trends on compact utility tractors indicate that front end loader attachment usage is increasing. A higher percentage of customers who purchase compact utility tractors have them equipped with loaders.

A front end loader attachment, including the mast, boom, and loader bucket, may be detachable from a compact utility tractor so that the tractor can be used for other work. If the front end loader attachment is detached from the tractor, a parking stand may help support the loader on the ground so that the tractor may be backed away therefrom. Examples of tractors with detachable front end loaders include U.S. Pat. Nos. 3,883,136; 4,470,751; 4,576,543; 4,797,051; 4,798,511; and 6,994,511.

Additionally, a quick attach device may be provided to hold the bucket to the loader boom. A quick attach device may lock the bucket in place, and allow quick removal of the bucket and replacement with another attachment. Examples of quick attach devices for a loader bucket include U.S. Pat. Nos. 3,512,665; 4,085,856; 4,253,793; 4,373,852; 4,643,631; and 4,787,811.

Although a loader attachment and/or bucket may be detached quickly from a compact utility tractor, the tractor is ordinarily shipped to the dealer or customer with the loader installed. Typically, several tractor/loaders are rolled or driven onto a tractor trailer or other shipping container, and parked in line immediately behind each other for shipping.

During shipping, a front loader attachment increases the overall length of a compact utility tractor by between about 20 inches and about 40 inches. As a result, the loader attachment reduces the number of tractors that can be shipped together on a tractor trailer or other shipping container. The loader attachment reduces shipping density and increases the shipping cost per tractor.

To maximize shipping density and reduce the shipping cost of compact utility tractors with loader attachments, the leading edge of each loader bucket may be positioned under the rear tires of the preceding tractor. This arrangement, however, can reduce the overall length of each tractor/loader by only about 10 inches. As a result, it provides just a small increase in shipping density and a small decrease of the shipping cost.

Another effort to maximize shipping density of tractor/loaders involves reducing the overall length of a tractor/loader by rolling the bucket back to a transport position. An example of a bucket rollback arrangement is shown in U.S. Pat. No. 4,884,940. However, rolling back the bucket may require adding linkages to the loader attachment, which may be cost prohibitive for many compact utility tractors.

Another attempt to maximize shipping density of tractor/loaders involves removing and stacking the loader buckets together, as shown, for example, in U.S. Pat. No. 6,374,520. A typical loader bucket has a weight of about 60 kg-100 kg, and a width of about 1.2 m-1.8 m. Due to their weight and size, stacking the loader buckets, and carrying them on and off a tractor trailer, is time and labor intensive.

Accordingly, there is a need to increase shipping density of compact utility tractors with factory installed front end loaders. There is a need to reduce shipping costs of compact utility tractors with loaders. There is a need for a simple, cost effective alternative to reduce the length of a compact utility tractor with a loader for shipment.

SUMMARY OF THE INVENTION

A loader bucket is attached to a compact utility tractor in a non-operational position for shipping, in which the bucket is held by a bracket off the ground between a pair of front wheels and a pair of rear wheels of the tractor. The bracket may be a steel plate, and a brace also may be provided between the bracket and the bucket. Shipping density of compact utility tractors with factory installed front end loaders bay be increased, and shipping costs may be reduced using the simple, cost effective method of reducing the length of a compact utility tractor with a loader for shipment

DESCRIPTION OF THE PREFERRED EMBODIMENT

Figure 1:
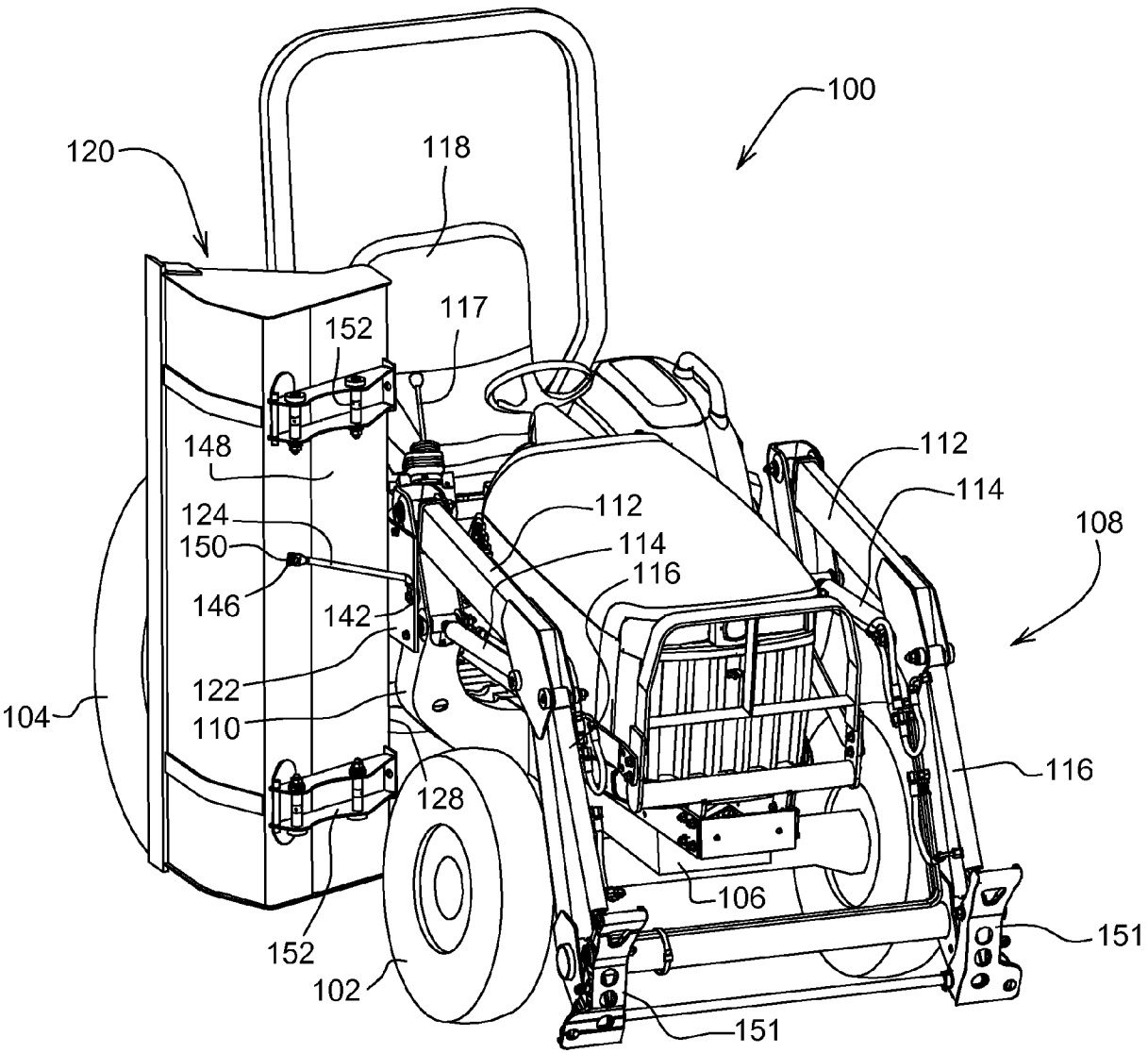
FIG. 1 is a front perspective view of a compact utility tractor with a loader bucket attached for shipping according to a first embodiment of the invention.
Figure 2:
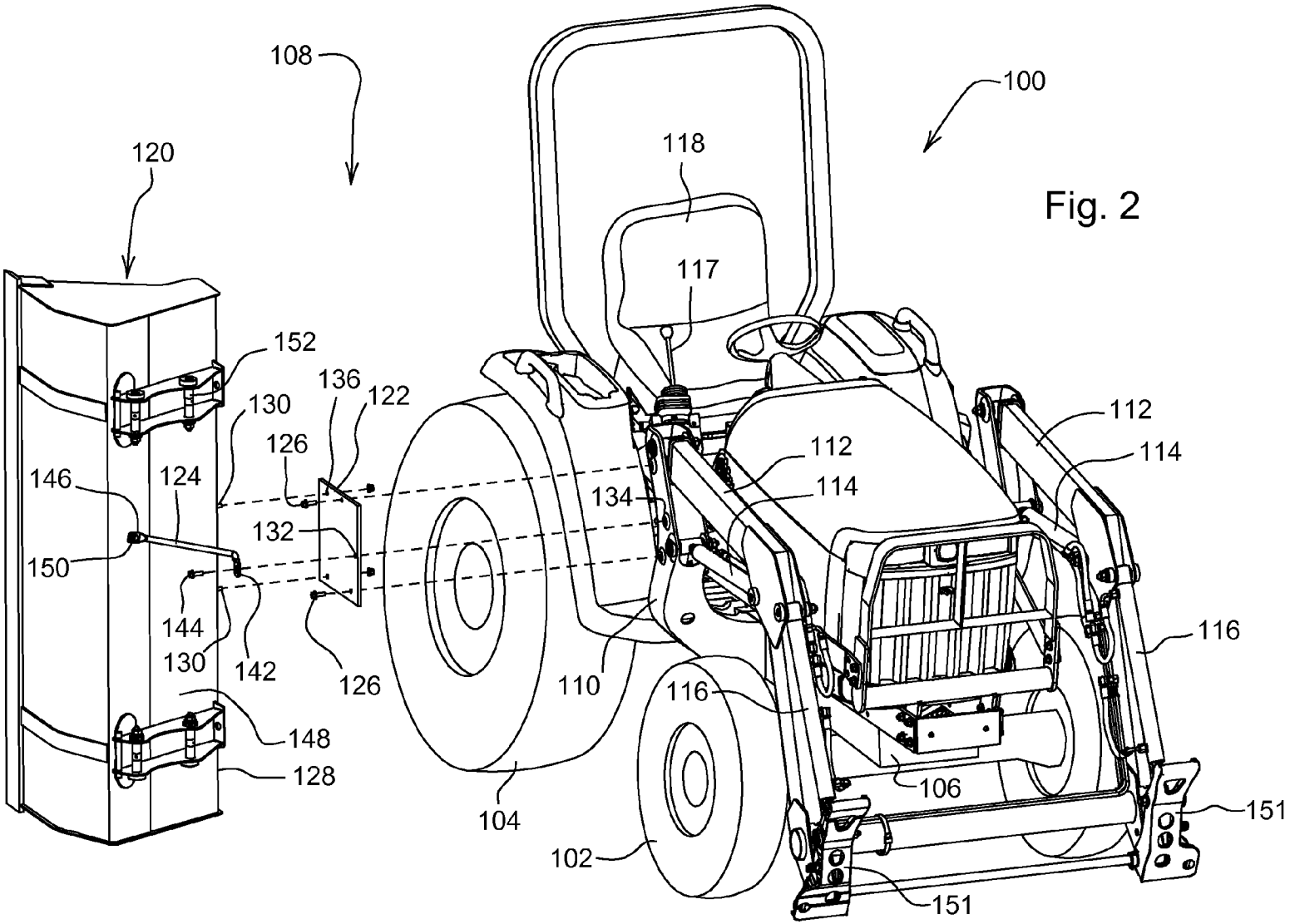
FIG. 2 is a front perspective view, partially exploded, of a compact utility tractor with a loader bucket attached for shipping according to a first embodiment of the invention.
Figure 3:
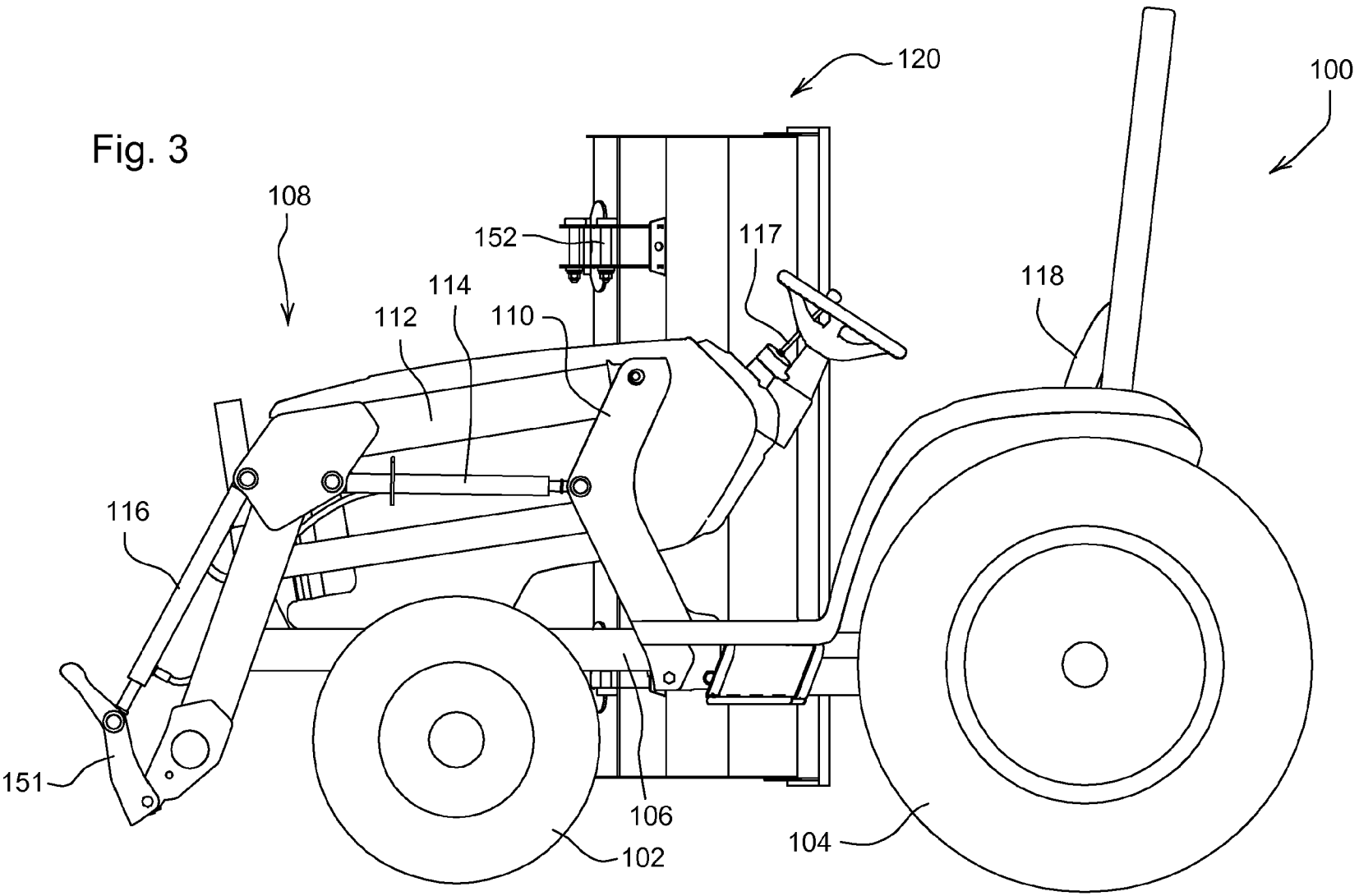
FIG. 3 is a side view of a compact utility tractor with a loader bucket attached for shipping according to a first embodiment of the invention.
Figure 4:
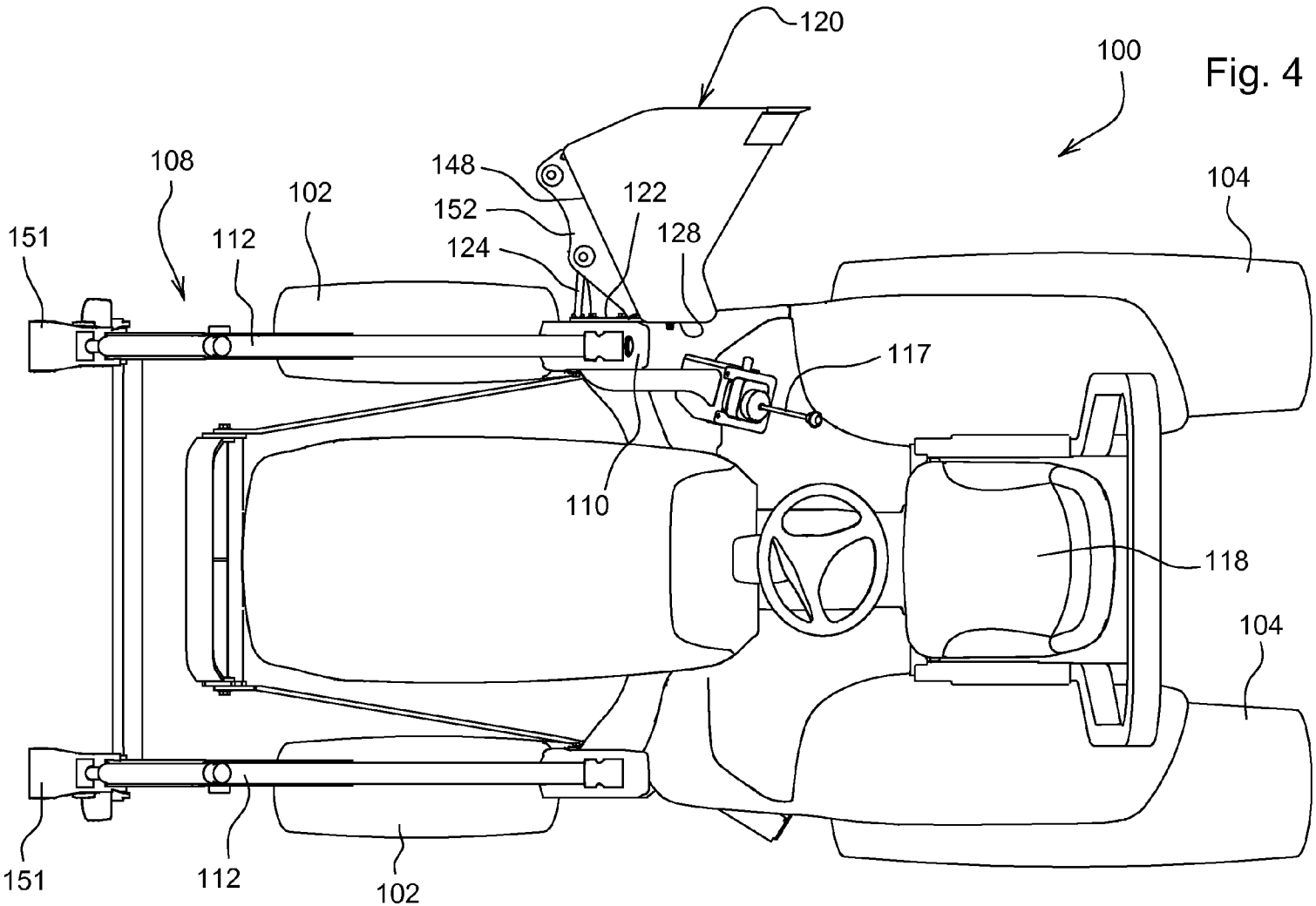
FIG. 4 is a top view of a compact utility tractor with a loader bucket attached for shipping according to a first embodiment of the invention.

FIGS. 1-4 show compact utility tractor 100 having front wheels 102 and rear wheels 104 supporting frame 106. The tractor is equipped with front end loader attachment 108 including mast 110 and boom 112. Hydraulic cylinders 114, 116 may be connected to operator controls 117 accessible from operator seat 118 for raising the loader and pivoting a loader bucket.

FIGS. 1-4 show bucket 120 attached to compact utility tractor 100 in a non-operational shipping position. The bucket is raised vertically off the ground at least about 4 inches, and not more than about 18 inches. After it is raised, the bucket may be attached to mast 110 in a substantially vertical alignment. Alternatively, the bucket may be attached to the mast at an inclined alignment. While the bucket is attached to the mast in a non-operating shipping position, either substantially vertical or inclined, the bucket does not obstruct the view of an operator on operator seat 118. Nor does the bucket obstruct or restrict the rear wheel traction drive or front wheel steering system of the tractor. Further, the bucket in the shipping position does not significantly destabilize the tractor.

In a preferred embodiment, loader bucket 120 may be attached and secured to mast 110 for shipping on either the left or right side of a compact utility tractor, between the front and rear wheels. The bucket may be attached with bracket 122 and brace 124.

In one embodiment, bracket 122 is a supporting structure between bucket 120 and mast 110. For example, the bracket may be a piece of sheet steel. Bracket 122 may be secured to mast 110 with threaded fasteners 126, and secured to a first outer surface (preferably upper surface 128) of bucket 120 with threaded fasteners 130. Bracket 122 may have a first set of holes 132 corresponding to holes 134 in mast 110, and a second set of holes 136 corresponding to holes (not shown) in upper surface 128 of bucket 120.

In one embodiment, brace 124 may be a rod that provides a stabilizing link between loader bucket 120 and bracket 122, preventing or limiting pivotal, turning or twisting movement of the bucket while it is attached for shipping. First end 142 of brace 120 may be secured to bracket 122 with threaded fastener 144, and second end 146 may be secured to a second outer surface (preferably rear surface 148) of bucket 120 with threaded fastener 150. Alternatively, the first end of brace 124 may be secured directly to mast 110.

In one embodiment, attaching loader bucket 120 to the tractor for shipping reduces the overall length of a tractor/loader by about 20 inches to about 36 inches. The tractor carries the bucket in the shipping position, and may be operated in forward or reverse, and rolled or driven on transportation ramps of shipping trailers or other shipping containers. The other components of the loader attachment, including mast 110, boom 112 and brace 114, remain attached to the compact utility tractor in their conventional, operating positions. After reaching the shipping destination, loader bucket 120 may be unattached from mast 110 and reconnected to the tractor in a conventional manner. For example, a quick attach device 151 may be used to connect each mounting 152 on rear surface 148 of the bucket to boom 112.

In one embodiment, attaching loader bucket 120 to the tractor for shipping increases the shipping density of compact utility tractors having front end loaders. Attaching the loader bucket in the manner described can reduce shipping costs of compact utility tractors with loaders. The present invention provides a simple, cost effective method of reducing the length for shipping compact utility tractors with loaders.

For example, the shipping density of compact utility tractors may be increased by shipping four tractor/loaders on a tractor trailer, instead of three. Attaching the loader bucket for shipping reduces the length of a tractor with a loader attachment by about 15 percent-20 percent. Additionally, the invention helps enable different combinations of tractors and loaders to be shipped together in less space.

Having described a preferred embodiment, it will become apparent that various modifications can be made without departing from the scope of the invention as defined in the accompanying claims.

The invention claimed is:

1. A loader bucket attached to a compact utility tractor for shipping comprising:

a supporting structure attached between a mast of the tractor and a first surface of the bucket holding the bucket in a vertically aligned non-operational shipping position raised off the ground surface; and a brace extending between the supporting structure and a second surface of the bucket to resist pivotal movement of the bucket.

2. The loader bucket attached to a tractor for shipping according to claim 1, wherein the tractor has a pair of rear traction drive wheels and a pair of front steerable wheels, and the bucket is positioned between the rear wheels and the front wheels without contacting any of the wheels.

3. The loader bucket attached to a tractor for shipping according to claim 1, wherein the supporting structure is a metal bracket.

4. A loader bucket attached to a compact utility tractor for shipping, comprising:

a bracket attached to a mast of the compact utility tractor and to the bucket holding the bucket off the ground in a non-operational position between a pair of front wheels and a pair of rear wheels of the tractor; and a brace between the bucket and the bracket.

5. The loader bucket attached to a tractor for shipping according to claim 4, wherein the bracket is a steel plate.

6. The loader bucket attached to a tractor for shipping according to claim 4, wherein the brace is a metal rod.

7. The loader bucket attached to a tractor for shipping according to claim 4, wherein the bracket is attached to a first outer surface of the bucket, and the brace is attached to a second outer surface of the bucket.

8. A method of attaching a loader bucket to a compact utility tractor for shipping, comprising:

raising the bucket off the ground in a non-operational position on a side of the tractor;

fastening a bracket between a mast of the tractor and a first surface of the raised bucket;

fastening a brace between the bracket and a second surface of the raised bucket.

* * * * *